US011140938B2

(12) United States Patent
Olivera, II

(10) Patent No.: US 11,140,938 B2
(45) **Date of Patent: *Oct. 12, 2021**

(54) HAT WITH ROTATABLE AND REMOVABLE BRIM

(71) Applicant: Abdalesis Olivera, II, Pembroke Pines, FL (US)

(72) Inventor: Abdalesis Olivera, II, Pembroke Pines, FL (US)

( * ) Notice: Subject to any disclaimer, the term of this patent is extended or adjusted under 35 U.S.C. 154(b) by 137 days.

This patent is subject to a terminal disclaimer.

(21) Appl. No.: 16/276,159

(22) Filed: Feb. 14, 2019

(65) Prior Publication Data

US 2019/0174854 A1 Jun. 13, 2019

Related U.S. Application Data

(63) Continuation of application No. 15/332,529, filed on Oct. 24, 2016, now Pat. No. 10,219,569, which is a continuation-in-part of application No. 14/254,100, filed on Apr. 16, 2014, now abandoned.

(51) Int. Cl.

| | |
|---|---|
| ***A42B 1/00*** | (2021.01) |
| ***A42B 1/0184*** | (2021.01) |
| ***A42B 1/0182*** | (2021.01) |

(52) U.S. Cl.

CPC ..... *A42B 1/0184* (2021.01); *A42B 1/0182* (2021.01)

(58) Field of Classification Search

CPC combination set(s) only.

See application file for complete search history.

(56) References Cited

U.S. PATENT DOCUMENTS

| | | | | |
|---|---|---|---|---|
| 2,213,661 | A | 9/1940 | Adamson | A42B 1/22 2/182.7 |
| 2,855,604 | A | 10/1958 | Austin | |
| 1,258,437 | A | 3/1981 | Sawatsky | |
| 5,437,062 | A | 8/1995 | Douglas | |
| 5,450,629 | A | 9/1995 | Gilstrap | |
| 5,471,684 | A | 12/1995 | Casale | |
| 5,533,211 | A | 7/1996 | Mehrens | |
| 5,715,534 | A | 2/1998 | Mobley | |
| 5,870,772 | A | 2/1999 | Sprouse | |
| 6,263,508 | B1 | 7/2001 | Davis | |
| 6,272,689 | B1 | 8/2001 | Kronenberger | |

(Continued)

*Primary Examiner* — Khaled Annis

(74) *Attorney, Agent, or Firm* — Laurence A. Greenberg; Werner H. Stemer; Ralph E. Locher

(57) ABSTRACT

A hat including a crown with a base. An outer headband layer is affixed to the crown at the base by a base seam that extends around a circumference of the crown. an inner headband layer is affixed to the outer headband layer at a position opposite the base to define a circumferential pocket between the outer headband layer and the inner headband layer. A rail has a T-shaped cross section disposed in the pocket. The T-shaped cross section is defined by a stem and an arm. The rail is affixed to the outer headband layer and the inner headband layer by a first rail seam through the stem, the outer headband layer, and the inner headband layer. The rail is further affixed to the outer headband layer by a second rail seam only through the outer headband layer and the stem. A bill has a track with a figure four shaped cross section affixed thereon. The track has a channel that receives and retains the rail therein to guide the bill around the crown.

9 Claims, 4 Drawing Sheets

(56) References Cited

U.S. PATENT DOCUMENTS

| | | | | |
|---|---|---|---|---|
| 6,370,696 | B1 | 4/2002 | Kronenberger | |
| 6,789,267 | B2 | 9/2004 | Ahn | |
| RE38,774 | E * | 8/2005 | Davis | A42B 1/064 2/10 |
| 7,240,373 | B2 | 7/2007 | Ahn et al. | |
| 2004/0040067 | A1 | 3/2004 | Pong | |
| 2004/0055073 | A1 | 3/2004 | Ahn | |
| 2004/0244094 | A1 | 12/2004 | Ahn et al. | |
| 2007/0017003 | A1 | 1/2007 | Harris et al. | |
| 2013/0276209 | A1 | 10/2013 | Lim | |
| 2015/0040292 | A1 | 2/2015 | Koh | A42B 1/064 2/195.7 |
| 2015/0296916 | A1 | 10/2015 | Olivera, II | A42B 1/064 2/181 |
| 2017/0035134 | A1 | 2/2017 | Olivera, II | A42C 5/02 |

* cited by examiner

HAT WITH ROTATABLE AND REMOVABLE BRIM

CROSS-REFERENCE TO RELATED APPLICATION

This application is a continuation of patent application Ser. No. 15/332,529, filed Oct. 24, 2016; which was a continuation-in-part of application Ser. No. 14/254,100, filed Apr. 16, 2014, now abandoned; the prior applications are herewith incorporated by reference in their entirety.

BACKGROUND OF THE INVENTION

Field of the Invention

The invention lies in the field of hats, such as baseball hats. The invention pertains, more particularly, to a hat having a bill that may be rotated around the periphery of the crown portion of the hat.

Hats with rotatable bills are well known. The hats have different constructions for providing the rotatable bill feature.

The following published documents represent pertinent prior art:

U.S. Pat. No. 6,789,267/US20040055073 to Ahn et al. describes a hat with a rotatable brim that includes respective sliding members that are provided in the crown portion and the brim. The construction of the sliding members is bulky and uncomfortable for a person wearing the hat.

U.S. Pat. No. 7,240,373 to Ahn et al. attempts to provide improvements to the above-noted sliding members. However, the construction remains bulky and thus uncomfortable. Likewise, the movement of the brim is not smooth and is not easy to adjust.

SUMMARY OF THE INVENTION

It is accordingly an object of the invention to provide a hat with a rotable brim which overcomes a variety of disadvantages, including those mentioned above, of the heretofore-known devices and methods of this general type and which provides for a hat with rotatable bill that is more compact, more comfortable and for which the brim is easily adjustable.

With the foregoing and other objects in view there is provided, in accordance with the invention, a hat including a crown with a base. An outer headband layer is affixed to the crown at the base by a base seam that extends around a circumference of the crown. An inner headband layer is affixed to the outer headband layer at a position opposite the base to define a circumferential pocket between the outer headband layer and the inner headband layer. A rail has a T-shaped cross section disposed in the pocket. The T-shaped cross section is defined by a stem and an arm. The rail is affixed to the outer headband layer and the inner headband layer by a first rail seam through the stem, the outer headband layer, and the inner headband layer. The rail is further affixed to the outer headband layer by a second rail seam only through the outer headband layer and the stem. A bill has a track with a figure four shaped cross section affixed thereon. The track has a channel that receives and retains the rail therein to guide the bill around the crown.

In accordance with another advantageous feature of the device of the invention, the figure four shaped cross section has a track stem that defines an overall height of the track. The track is affixed on the bill to present the track stem towards the inner headband layer and the track stem has a flat surface disposed along the inner headband layer.

In accordance with a further feature of the device of the invention, the bill has a substrate sandwiched between fabric layers. The fabric layers have turned up portions at the track that abut an end of the track stem.

In accordance with an added preferred feature of the device of the invention a fabric band encircles the track stem to affix the track to the bill. A track seam is provided through the track stem and opposing layers of the band. A bill seam is provided through the turned up portions and the opposing layers.

In accordance with an added preferred feature of the device of the invention one of the layers of the band extends substantially entirely over the flat surface of the track stem.

In accordance with an additional particularly advantageous and thus preferred feature of the device of the invention, the track seam is adjacent the channel.

In accordance with yet another advantageous feature of the device of the invention, the bill seam is disposed between the substrate and a base of the track stem.

In accordance with still yet another advantageous feature of the device of the invention, the first rail seam is disposed at a base of the stem.

In accordance with still another advantageous feature of the device of the invention, the rail has two ends opposite one another in the pocket and spaced apart from one another for defining a gap therebetween. The gap receives the channel and allows the channel to be fed onto the rail.

With the foregoing and other objects in view there is provided, in accordance with the invention there is also provided a hat including a crown having a base. An outer headband layer is affixed to the crown at the base by a base seam that extends around a circumference of the crown. An inner headband layer is affixed to the outer headband layer at a position opposite the base to define a circumferential pocket between the outer headband layer and the inner headband layer. A rail has a T-shaped cross section disposed in the pocket. A bill has a track with a figure four shaped cross section affixed thereon, the track having a channel that receives and retains the rail therein to guide the bill around the crown. The figure four shaped cross section has a track stem defining an overall height of the track, the track stem having a flat surface. The track is affixed on the bill to present the flat surface towards the inner headband layer. The flat surface is disposed along the inner headband layer.

In accordance with another advantageous feature of the device of the invention, the bill has a substrate sandwiched between fabric layers, the fabric layers have turned up portions at the track that abut an end of the track stem.

In accordance with yet another advantageous feature of the device of the invention, a fabric band encircles the track stem to affix the track to the bill.

A track seam is provided through the track stem and opposing layers of the band, and a bill seam is provided through the turned up portions and the opposing layers.

In accordance with still yet another advantageous feature of the device of the invention, one of the layers of the band extends substantially entirely over the flat surface of the track stem.

In accordance with yet a further advantageous feature of the device of the invention, the T-shaped cross section is defined by a rail stem and an arm. The rail is affixed to the outer headband layer and the inner headband layer by a first rail seam through the rail stem, the outer headband layer.

The rail is further affixed to the outer headband layer by a second rail seam only through the outer headband layer and the rail stem.

In accordance with yet still a further advantageous feature of the device of the invention, the track stem defines a side of the channel.

Any desired combination of the invention described above and the advantageous embodiments of the invention described above likewise forms an advantageous embodiment of the invention.

Other features which are considered as characteristic for the invention are set forth in the appended claims.

Although the invention is illustrated and described herein as embodied in hat with a rotatable bill, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
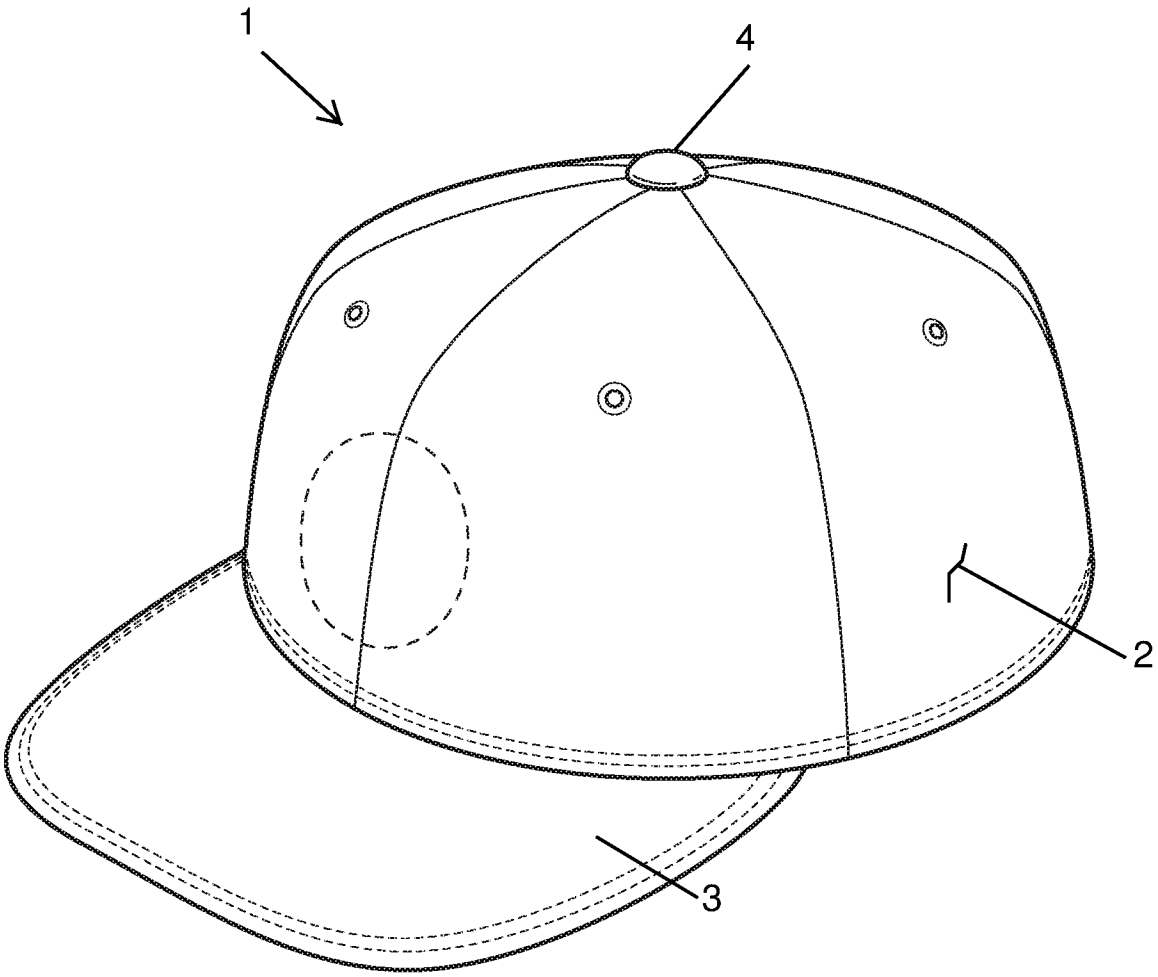
FIG. 1 is a perspective view of a hat with a bill attached to a crown.
Figure 2:
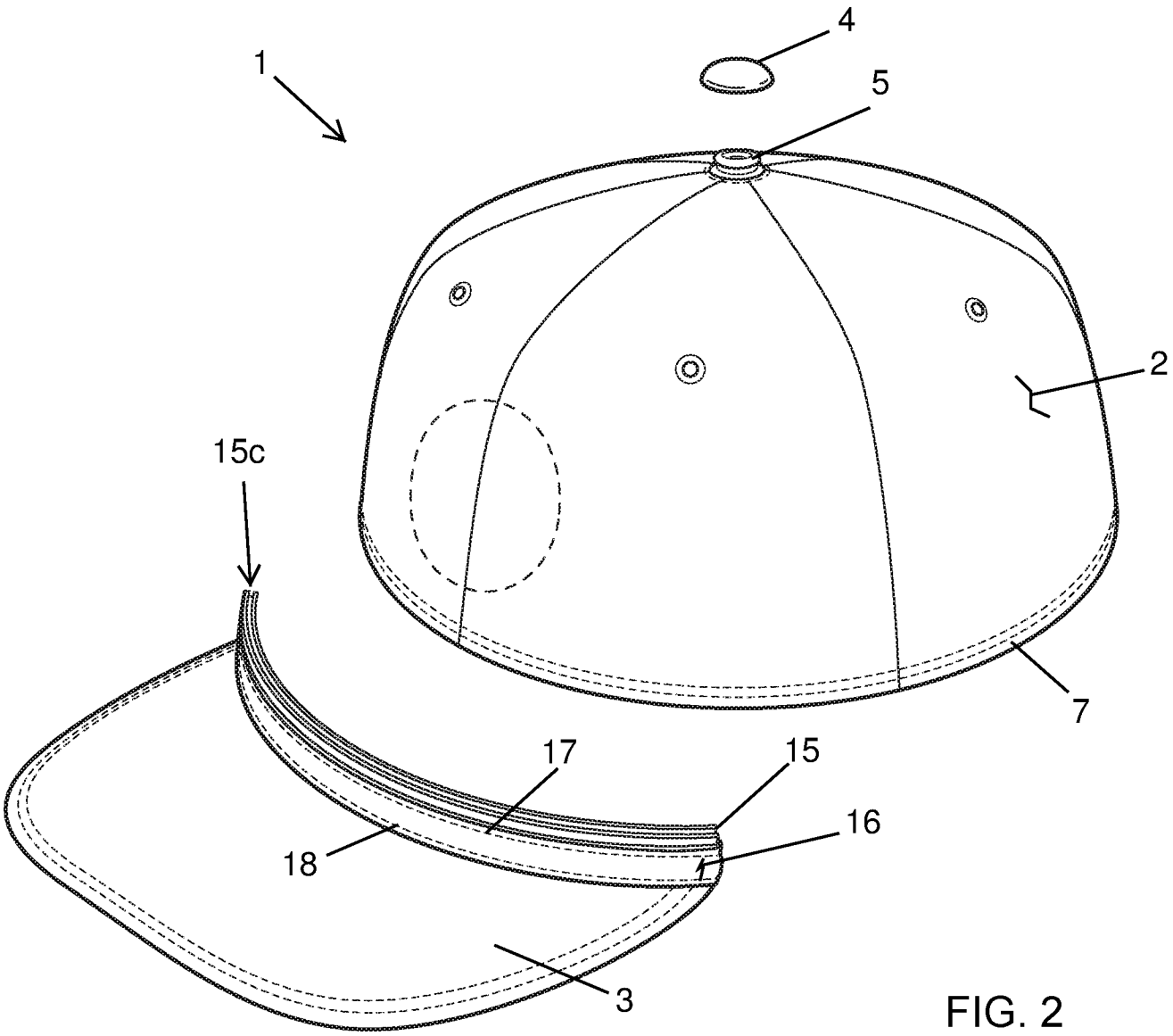
FIG. 2 is a perspective view of the hat of FIG. 1 with the bill removed from the hat.

Referring now in detail to the figures of the drawings, in which like elements and components bear like reference symbols, and first, particularly, to FIGS. 1 and 2 thereof, where there is seen a perspective view of a hat 1 having a crown 2 with a removably attached bill or visor 3 attached to the crown 1. The hat 1 has a button 4 that is provided as a fabric covered female snap half, which can be removed from a male snap half 5 on the crown 2 and replaced with a different color button 4.

Figure 3:
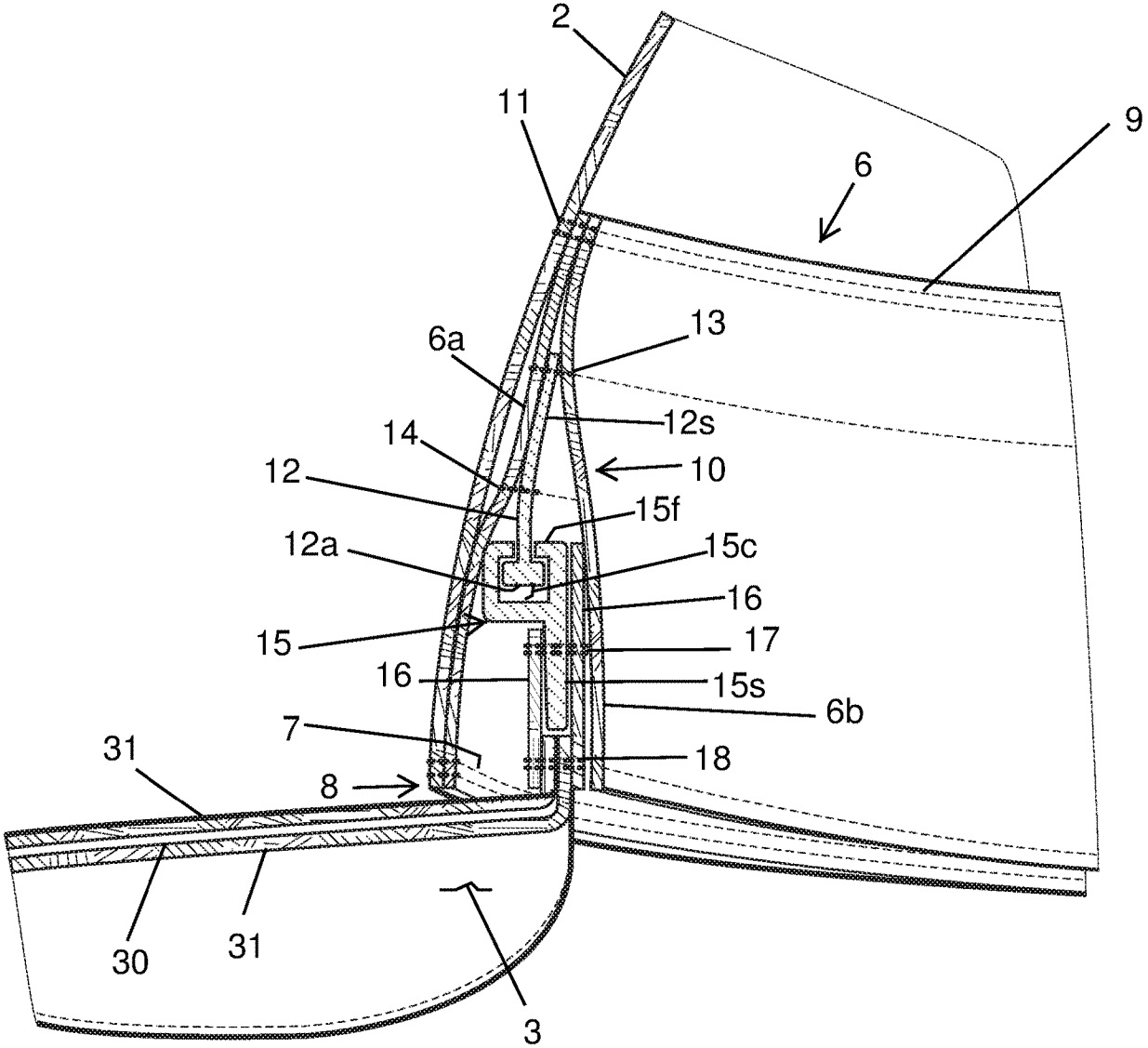
FIG. 3 is a partial section view through the hat and the bill with the bill attached.
Figure 4:
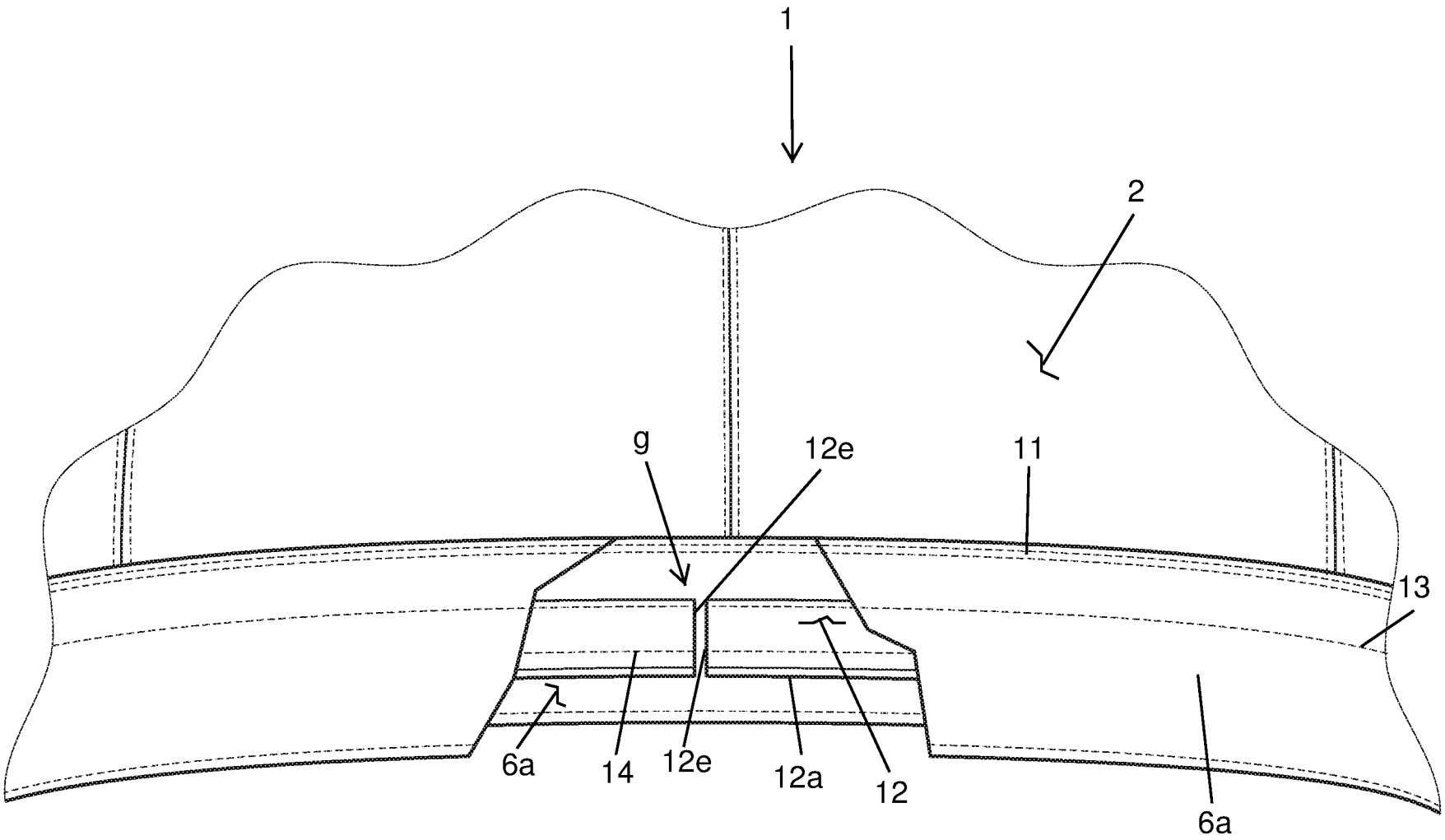
FIG. 4 is a view of the crown with a portion of the headband removed at a position along the headband where the bill is inserted onto a rail of the hat.

FIG. 3 shows a section view through the bill 3 and the crown 2. The crown 2 is provided with a headband or sweatband 6. The headband 6 has an outer headband layer 6*a* affixed to the crown 2 with a seam 7 at a base 8 of the crown 2. The seam 7 extends around the perimeter of the crown 2. The seam 7 may be a double seam. The outer headband layer 6*a* extends from the seam 7 along an inner side of the crown 2 up to a seam 9 that affixes the outer headband layer 6*a* to an inner headband layer 6*b* around the perimeter of the crown 2 for defining a circumferential pocket 10 between the inner headband layer 6*b* and the outer headband layer 6*a* around the circumference of the crown 2. The seam 9 may be provided as a double seam.

The section is taken at a position where a point stitch 11 affixes the top of the headband 6 to the crown 2. The head band 6 may be provided with several of the point stitches 11 around the perimeter of the crown 2. The point stitches 11 are provided at a discrete location, such as along a seam that joins individual panels of the crown 2 or at an embroidered logo that is provided on the crown 2 so that the stitches 11 are not seen on an exterior of the crown 2. The point stitches 11 hold the head band 6 in the crown 2 and prevents the headband 6 from being pulled down out of the crown 2 when the bill 3 is rotated about the crown 2.

A rail 12 having a T-shaped cross section is disposed in the pocket 10. A seam 13 through the outer and inner headband layers 6*a* and 6*b* at a base of a stem 12*s* of the "T" holds the rail 12 in the pocket 10. A second seam 14 through the outer headband layer 6*a* and the stem 12*s* adjacent a transverse arm 12*a* of the "T" serves to bias the rail 12 to and outer headband layer side of the pocket 10. This assist in allowing the bill 3 to rotate more freely about the crown 2. A base of the inner headband layer 6*b* is shown with an additional seam (not numbered) that affixes a bent over end (not shown) of the inner headband layer 6*b*.

The bill 3 of the hat includes a substrate material 30 that is sandwiched between fabric layers 31. At an end of the bill 3 that is attached to the crown 2, the fabric layers 31 are brought together at a turned up portion of the fabric layers 31. The turned up portion is substantially perpendicular to the substrate material 30. The bill 3 has a track 15 with a figure four shaped cross section or an inverted h cross section affixed thereto. Ends of the turned up portions of the fabric layers 31 abut a stem 15*s* of the track 15.

The track 15 is affixed to the bill 3 by a fabric band 16 that extends around the stem 15*s* of the track 15 via a first track seam 17 through the band 16 and the stem 15*s* and by a second track seam 18 through the band 16 and the bent portion of the fabric layers 31. The stem 15*s* defines an overall height of the track 15 and is disposed to provide the track 15 with a flat surface that is disposed along the inner headband layer 6*b* and thus to the head of a wearer to make the construction of the track/rail assembly more comfortable for a person to wear. Furthermore, it is preferable for the band 16 to extend up a majority of the length of the stem 15*s* in order to maintain a flat face against the inner headband liner 6*b*. On the opposite side of the stem 15*s*, the band 16 extends substantially up to an underside of a channel 15*c* of the track 15. The channel 15*c* has opposing inwardly directed flanges 15*f* that retain the arm 12*a* of the rail 12 in the channel 15*c* as the stem 12*s* passes through a space defined between the flanges 15*f* and allows the bill 3 to rotate about the crown 2.

The rail 12 is manufactured by extrusion molding and the rail 12 has the characteristics of a rail that is extruded. The rail 12 is provided from a continuous reel of rail 12 and is cut to length according to a corresponding crown size. The rail 12 is affixed in the pocket 10 around the crown 2 so that rail ends 12*e* are spaced apart at a small distance (less than 3 mm) a gap therebetween, the gap receives the track and allows the track channel 15*c* to be fed onto the rail 12.

The invention claimed is:

1. A hat, comprising:

a crown having a base;

a headband layer affixed to said crown at said base by a base seam extending around a circumference of said crown;

a rail having a T-shaped cross section, said T-shaped cross section being defined by a rail stem and an arm, said rail being affixed to said headband layer; and a bill having a fabric band and a track affixed thereon, said track having a track stem and a channel receiving and retaining said rail therein for guiding said bill onto said crown, said channel having opposing parallel side segments each having respective inwardly directed flanges defining a space therebetween, said inwardly directed flanges retaining said arm of said rail in said channel as said rail stem passes through said space allowing said bill to rotate onto said crown, said track stem defining one of said opposing parallel side segments of said channel and establishing a flush surface over a height of said track, said track stem being affixed onto said fabric band with said flush surface directed toward a head of a wearer of the hat.

2. The hat according to claim 1, wherein said track stem that defines an overall height of said track.

3. The hat according to claim 1, further comprising a bill seam through said track stem and said fabric band.

4. The hat according to claim 3, wherein said fabric band extends substantially entirely over said flush surface.

5. The hat according to claim 3, wherein said bill seam is adjacent said channel.

6. The hat according to claim 1, further comprising a rail seam through said rail stem.

7. The hat according to claim 1, wherein said rail has two longitudinal ends for said channel to be fed onto said rail.

8. A hat, comprising:

a crown having a base;

an outer headband layer affixed to said crown at said base by a base seam extending around a circumference of said crown;

an inner headband layer opposite said outer headband layer;

a rail having a T-shaped cross section affixed to said outer headband layer;

a bill having a track with a channel receiving and retaining said rail therein for guiding said bill onto said crown, said track having a track stem defining a first linear sidewall of said channel and defining an overall height of said track, said track stem defining a flat surface, said track being affixed on said bill for presenting said flat surface towards said inner headband layer, said flat surface disposed against said inner headband layer.

9. The hat according to claim 8, wherein said channel has a second linear side wall opposite said first linear side wall said first and second linear sidewalls each having respective inwardly directed flanges defining a space therebetween, said rail has a stem and an arm that define said T-shape cross section, said inwardly directed flanges retaining said arm of said rail in said channel as said rail stem passes through said space allowing said bill to rotate onto said crown.

* * * * *